US005933865A

United States Patent [19]

Aldridge

[11] Patent Number: 5,933,865

[45] **Date of Patent: *Aug. 10, 1999**

[54] MULTI-USE HAZARDOUS DUTY GARMENT

[75] Inventor: Donald Aldridge, New Carlisle, Ohio

[73] Assignee: Lion Apparel, Inc., Dayton, Ohio

[ * ] Notice: This patent is subject to a terminal disclaimer.

[21] Appl. No.: 08/901,923

[22] Filed: Jul. 29, 1997

Related U.S. Application Data

[63] Continuation of application No. 08/464,068, Jun. 5, 1995, Pat. No. 5,685,015.

[51] Int. Cl.[6] ..... A41D 13/00

[52] U.S. Cl. ..... 2/81; 2/93

[58] Field of Search ..... 2/70, 81, 85, 93, 2/96, 97, 904, 272, 915

[56] References Cited

U.S. PATENT DOCUMENTS

| | | | |
|---|---|---|---|
| 2,582,772 | 1/1952 | Egbert | 2/97 |
| 4,103,361 | 8/1978 | Carmen | 2/97 |
| 4,502,153 | 3/1985 | Lapedes et al. | 2/81 |
| 4,768,233 | 9/1988 | Grilliot et al. | 2/81 |
| 4,774,725 | 10/1988 | Page | 2/81 |
| 4,843,647 | 7/1989 | Phillips, Sr. et al. | 2/69 |
| 4,999,850 | 3/1991 | Grilliot et al. | 2/126 |
| 5,072,454 | 12/1991 | Trahan | 2/70 |
| 5,136,723 | 8/1992 | Aldridge et al. | 2/81 |
| 5,189,737 | 3/1993 | Ribicic | 2/93 |
| 5,406,648 | 4/1995 | Butzer et al. | 2/81 |

*Primary Examiner*—Michael A. Neas
*Attorney, Agent, or Firm*—Thompson Hine & Flory LLP

[57] ABSTRACT

A multi-use hazardous duty garment ensemble, such as a firefighting turnout garment, comprises an outer shell component and a removable inner liner component positioned within the outer shell component. The inner liner component is separable by the outer shell component and is adapted to be wearable as a second hazardous duty garment, such as an emergency medical service garment or a station work uniform garment. The outer shell component, separated from the inner liner component, is adapted to be wearable as a third hazardous duty garment, such as a wildfire brush fire firefighting garment.

11 Claims, 3 Drawing Sheets

MULTI-USE HAZARDOUS DUTY GARMENT

CROSS-REFERENCE TO RELATED APPLICATIONS

This application is a continuation of U.S. patent application Ser. No. 08/464,068, filed Jun. 5, 1995, now U.S. Pat. No. 5,685,015.

BACKGROUND OF THE INVENTION

The present invention relates to hazardous duty garments and, more particularly, to hazardous duty garments having multiple components which can be worn separately or in combination to meet specific hazardous duty applications.

A typical firefighting ensemble comprises a turnout coat and pant, each of which has an outer shell, a moisture barrier located within the outer shell, and a thermal liner. The outer shell typically is constructed of a flame and heat resistant material such as woven aramid and/or polybenzamidazole ("PBI") fibers. Commercially available aramid fibers are NOMEX and KEVLAR (both are trademarks of E. I. Dupont de Nemours & Co., Inc.). The moisture barrier typically includes a membrane layer, which is moisture vapor permeable but is impermeable to liquid moisture and air, bonded to a substrate of a flame and heat resistant material, such as the aramid or PBI material of the outer shell, only lighter in weight. The thermal liner is typically positioned within the moisture barrier in order to prevent it from soaking up liquid moisture flowing through the outer shell from the ambient environment and comprises a needlepunch or batting of an aramid fiber.

Each layer of the ensemble must meet National Fire Protection Association ("N.F.P.A.") standard 1971 ("Protective Clothing for Structural Fire Fighting") which includes standards for heat and flame resistance and tear strength. For example, the outer shell must be able to resist burning, melting, dripping and separation at a temperature of 500° F. for five minutes. The moisture barrier typically is made of expanded polytetraflouroethylene ("PTFE") such as GORE-TEX (a trademark of W. L. Gore & Associates, Inc.). All layers combined must provide a thermal protection performance ("TPP") rating of at least 35.

The moisture barrier and thermal liner are often stitched together to form a unitary component which is removably attached to the outer shell by snaps and/or hook and loop fasteners. While the combined moisture barrier and thermal liner may be removable from the outer shell, this component is not designed to be worn separately apart from the outer shell, because it lacks such items as a front closure mechanism (e.g. a slide fastener), a collar, or an outer layer of material to protect the component from abrasion.

Another type of hazardous duty garment is a wildlands brush fire firefighting garment. Such a garment must meet N.F.P.A. 1977 performance standard, which require an outer shell of heat, flame, abrasion and tear resistant material, but do not require a moisture barrier or a thermal liner because of the relatively open, drier conditions typically encountered in fighting brush fires. A third type of garment currently in service is an emergency medical service ("EMS") jacket worn, for example, by ambulance teams. Such jackets must meet N.F.P.A. 1999 performance standard for protection against blood borne pathogens. Accordingly, an EMS garment must, for example, have a storm flap covering the front closure and include a moisture barrier.

If a fire department is to have the capability of responding to all of the emergency situations set forth above, it must have on hand a complete inventory of all such garments. For example, it is not desirable to use the conventional turnout ensemble for wildlands brush fire duty, because the thermal liner and moisture barrier would add unnecessarily to the weight and heat retention of the garment, thereby imposing additional stress upon the wearer. Similarly, it is not desirable to wear a wildlands brush fire garment for EMS duty since it does not provide adequate protection against blood borne pathogens.

A disadvantage with having all types of hazardous duty garments in inventory lies in the expense and space required to purchase, maintain and store all three of such garments. Accordingly, there is a need for a hazardous duty garment which is configurable to accommodate more than one hazardous duty application.

SUMMARY OF THE INVENTION

The present invention is a multi-use hazardous duty garment which is configurable to meet applicable N.F.P.A. performance standards for firefighting garments, wildlands brush fire firefighting garments and EMS duty garments, and function as station work uniforms. Consequently, a fire station or emergency service facility need only keep in inventory and maintain the multi-use garments of the present invention to provide personnel with appropriate protection for firefighting, brush fire firefighting, EMS duties, and station work situations.

In accordance with the present invention, a multi-use hazardous duty garment comprises an outer shell component and a removable inner liner component. When the garment is worn as an ensemble of the outer shell and inner liner components, it meets the relevant performance requirements for a firefighting turnout garment. When only the outer shell component is worn, the garment meets the performance requirements for wildlands brush fire firefighting. Conversely, when only the removable inner liner component is worn, the garment meets the performance requirements for EMS duty and can function as a station work uniform jacket.

The multi-use capability of the garment of the present invention results, in part, from the construction of the inner liner, which enables it to be worn as a separate garment. The inner liner includes its own closure mechanism, finished cuffs and a collar. In a preferred embodiment, the cuffs are finished with knit wristlets and the front closure mechanism includes a slide fastener. Similarly, the outer shell has its own closure mechanism, collar and cuffs, which enable the outer shell to be worn alone as a separate garment.

Further, the inner liner is finished with an outer shell of a heat and flame resistant and abrasion resistant material, such as an aramid and/or PBI fiber, to protect the moisture barrier and thermal liner. In addition, the outer shell of the inner liner preferably includes strips of reflective material for visibility in low light situations. The inner liner is attachable to the outer shell by means such as a slide fastener or hook and loop fastener strips.

In an alternate embodiment of the invention, the inner liner includes a thermal barrier which comprises a layer of apertured, closed-cell foam attached to a substrate of woven aramid polymer fabric such as NOMEX. The moisture barrier comprises a layer of a semi-permeable PTFE membrane material such as GORE-TEX attached to a substrate of a filament face cloth. The thermal barrier is oriented such that the substrate faces outwardly and acts as the outer shell for the inner liner when worn alone. The moisture barrier is oriented such that the substrate faces inwardly and acts as a face cloth for the inner liner, as well as for the entire ensemble.

The filament material of the face cloth minimizes friction between the garment and the wearer, which facilitates donning and doffing the garment and reduces wearer stress by minimizing the effort required to move and perform tasks while wearing the garment. The foam thermal layer does not appreciably absorb moisture, and therefore can be placed outside of the moisture barrier, an orientation which enhances moisture vapor transport from the wearer through the moisture barrier. Accordingly, it is an object of the present invention to provide a multi-use hazardous duty garment which comprises multiple components, each of which is wearable separately to meet specific and unique hazardous duty performance requirements, and which can be worn together such that the combined ensemble meets different, unique hazardous duty performance requirements; a garment which has multiple uses, thereby minimizing the inventory of garments which must be maintained in order to provide hazardous duty garments for a variety of situations; and a multi-use hazardous duty garment which is relatively simple to construct, is not overly heavy, and is relatively easy to maintain.

Other objects and advantages of the present invention will be apparent from the following description, the accompanying drawings and the appended claims.

DETAILED DESCRIPTION

Figure 1:
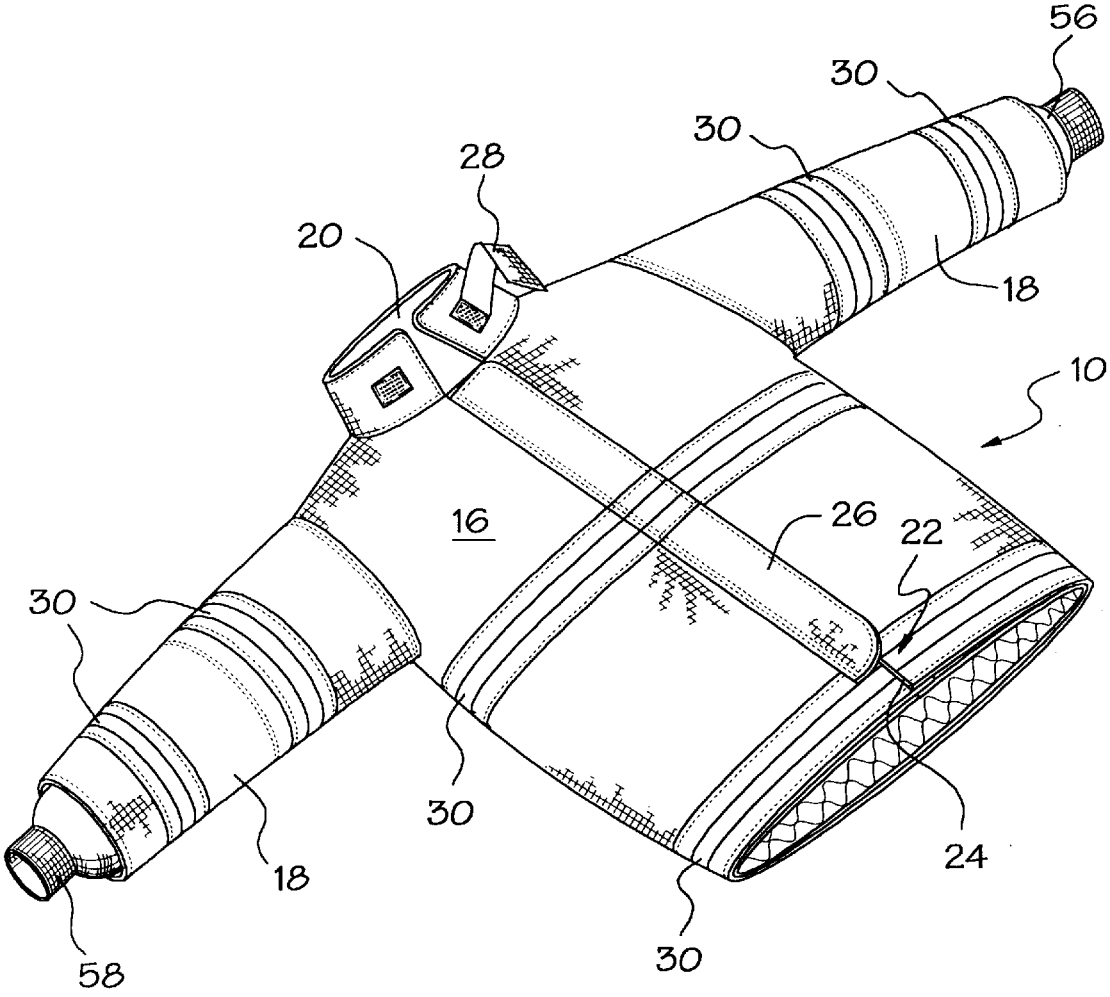
FIG. 1 is a perspective view of a preferred embodiment of the present invention embodied in a firefighting turnout coat ensemble.

As shown in FIG. 1, the multi-use hazardous duty garment of the present invention, generally designated 10, comprises an ensemble which functions as a firefighting turnout coat. The garment 10 is a combination of an outer shell 12 and an inner liner 14 (see FIG. 2). The turnout coat comprises a body portion 16, two sleeves 18 and a collar 20 attached to the body portion. The body portion 16 of the outer shell 12 included a front opening 22 having a closure, which in the preferred embodiment is a slide fastener 24. A storm flap 26 is shaped and positioned to cover the front closure 24 of the turnout coat 10. While the outer shell closure preferably is a slide fastener 24, it is within the scope of the invention to use additional closure means such as buttons, snaps, hook and pile strips and the like. The collar 20 is also provided with a closure 28 (see FIG. 1) for securing the collar protectively around the wearer's neck. Reflective strips 30 are stitched to the outer shell 12 at sleeves 18 and body portion 16 to increase visibility in low light conditions.

Figure 2:
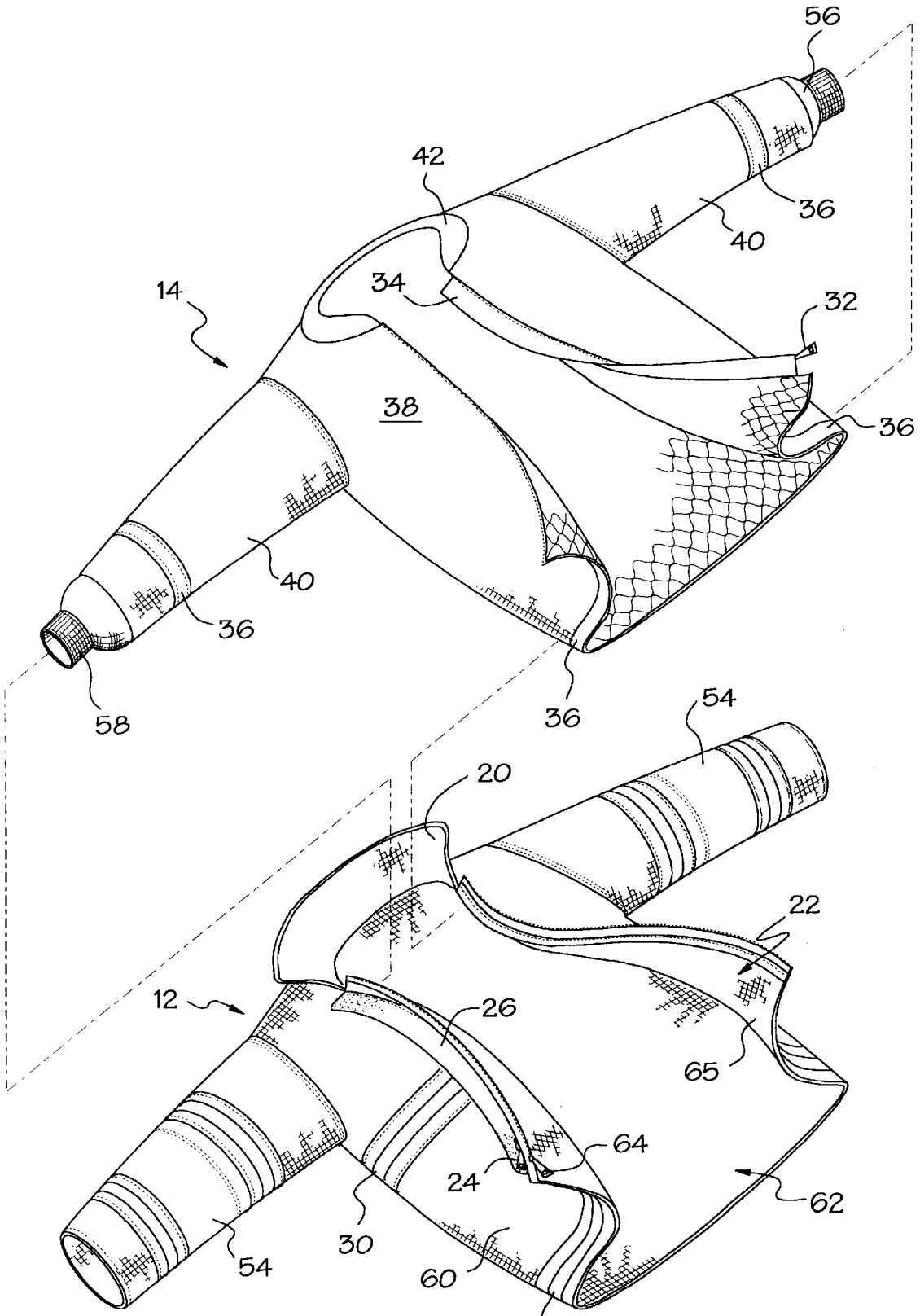
FIG. 2 is an exploded, perspective view of the garment of FIG. 1, where the inner liner of the garment is separated from the outer shell.

As shown in FIG. 2, the turnout coat 10 is separable into two components: an inner liner 14 and an outer shell 12, where each of the two components 12, 14 is correspondingly adapted to be wearable separately as a protective garment. In the present embodiment 10, the inner liner garment 14 is adapted to be worn as an EMS jacket which meets N.F.P.A. 1999 standard and as a station work uniform which preferably has an outer shell of heat and flame resistant, and abrasion resistant, material. The outer shell garment 12 is adapted to be worn as a wildlands brush fire firefighting jacket meeting the N.F.P.A. 1977 standard.

To be wearable as a separate protective garment, the inner liner 14 has a closure in the form of a slide fastener 32 for securing the inner liner garment about a wearer. Furthermore, a storm flap 34 shaped to cover the closure 32 is provided to substantially block transmission of fluid borne and blood borne pathogens through the closure 32. While the closure is preferably a slide fastener 32, it is within the scope of the invention to substitute closures such as buttons, snaps, or hook and loop mechanisms. Strips of reflective material 36 are stitched to the outer surfaces of the inner liner garment 14 to increase visibility in low light conditions.

Figure 3:
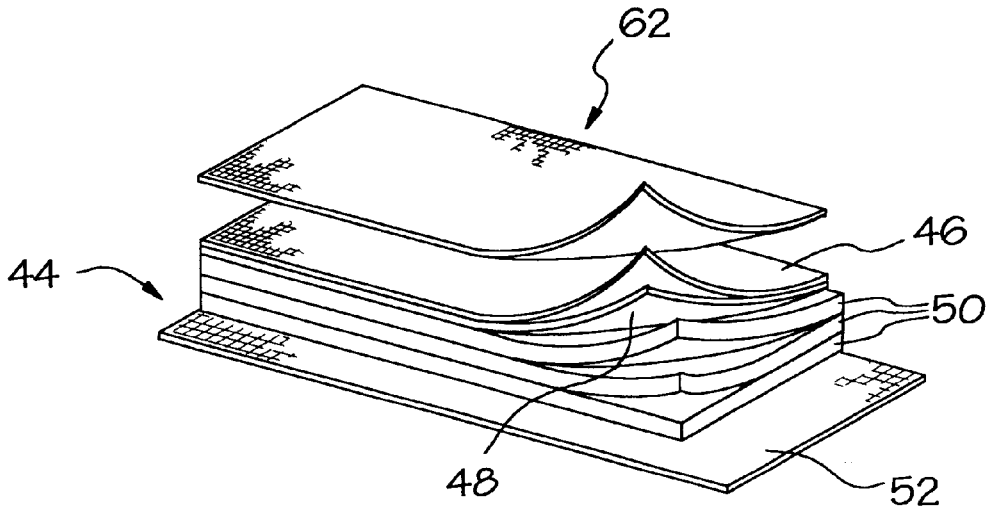
FIG. 3 is a detail of the garment of FIG. 1 showing the layers of protective material comprising the inner liner component and the outer shell component.

The inner liner garment 14, which functions as an EMS jacket or as a stationhouse jacket, has a body portion 38, sleeves 40 and a collar 42. The body and sleeve portions 38, 40 are designed to protect the wearer's upper-body and are thus constructed of several layers of protective material. As shown in FIG. 3, the layers of inner liner material 44 used in the body and sleeve portions 38, 40 comprise an outer layer 46 of abrasion, flame and heat resistant material; a layer of moisture barrier material 48 inside of the outer layer material, preferably bonded to the outer layer material; at least one layer of thermal barrier material 50 (three layers are shown) inside of the moisture barrier layer; and a layer of face cloth material 52 inside of the thermal barrier layers which is the innermost layer of the inner liner garment 14.

The outer layer 46 of the inner liner garment 14 is preferably a multifilament yarn of an aramid polymer material such as NOMEX (but a blend of aramid polymer materials such as NOMEX and KEVLAR may be used). The filament yarn of the NOMEX material gives the outer surface a slick or silky feel which facilitates the insertion of the sleeves 40 of the inner liner garment 14 within sleeve portions 54 of the outer shell garment 12. Therefore, the inner liner garment 14 and the outer shell garment 12 can be easily combined or separated or separated from each other. Alternatively, the outer layer 46 is made of a twill weave of aramid or PBI fibers. The moisture barrier layer 48 of the inner liner garment 14 is preferably a semi-permeable PTFE material, such as GORE-TEX, bonded to the outer layer filament aramid polymer material, such as NOMEX 46. The thermal barrier layer 50 preferably comprises three layers of apertured aramid polymer materials or batting such as NOMEX, commercially available as E-89. Alternatively, single or multiple layers of NOMEX and/or KEVLAR materials or batting can be used as the thermal barrier layer 50.

Additionally, it is within the scope of the invention that the above materials may be readily substituted with other materials having similar protective properties, or alternative protective properties corresponding to other specialized hazardous use garments.

In the preferred embodiment, as shown in FIGS. 1 and 2, the cuffs 56 of the inner liner garment are finished with knit wristlets 58 of aramid material, and when inserted through the sleeve portion 54 of the outer shell 12, the knit wristlets 58 provide flame and heat protection for the ensemble 10.

As shown in FIG. 2, the outer shell 12 has a body portion 60 and sleeves 54. The outer shell 12 is adapted to be worn separately from the inner liner 14. In the preferred embodiment, the outer shell garment 12 functions as a wildlands brush fire firefighting garment. The outer shell garment 12 comprises a closure 24 for securing the outer shell garment about the wearer. The closure 24 thus provides a closure for the garment ensemble 10 as well as the outer shell garment 12. As shown in FIG. 3, the layer of outer shell material 62 used in the body and sleeves portion 60, 54 is an abrasion, flame and heat resistant material. The material 62 of the outer shell 12 is preferably a KEVLAR and PBI combination pajama check weave.

As shown in FIG. 2, when the inner liner 14 is inserted within the outer shell 12, means may be provided to releasably attach the inner liner to the outer shell. Such means can take the form of slide fasteners, buttons, snaps, hook and loop strips or any similar variant. In the present embodiment an additional slide fastener 64 is provided on an inner surface 65 of the outer shell proximate to the opening 22 and substantially parallel to slide fastener 24. The additional slide fastener 64 is configured to engage the slide fastener 32 of the inner liner 14. Thus, when combined into the garment ensemble 10, the inner liner closure 32 is used to releasably attach the inner liner 14 to the outer shell 12, and the outer shell closure 24 is used as the closure for the garment ensemble 10.

As can be seen in FIG. 3, the inner liner layers 44 and outer shell layer 62 are combined to form the garment ensemble 10. Thus, the full ensemble garment 10 has an outer layer of material 62 which is resistant to abrasion, heat and flame; a layer of material 46 inside of the outer layer providing an additional layer of abrasion, flame and heat resistance; a third layer of material 48 bonded to the second layer 46 providing a moisture barrier layer; below the moisture barrier 48, several layers of thermal barrier material 50; and inside of the thermal barrier layers 50, and providing the innermost layer of material, a face cloth material 52.

Figure 4:
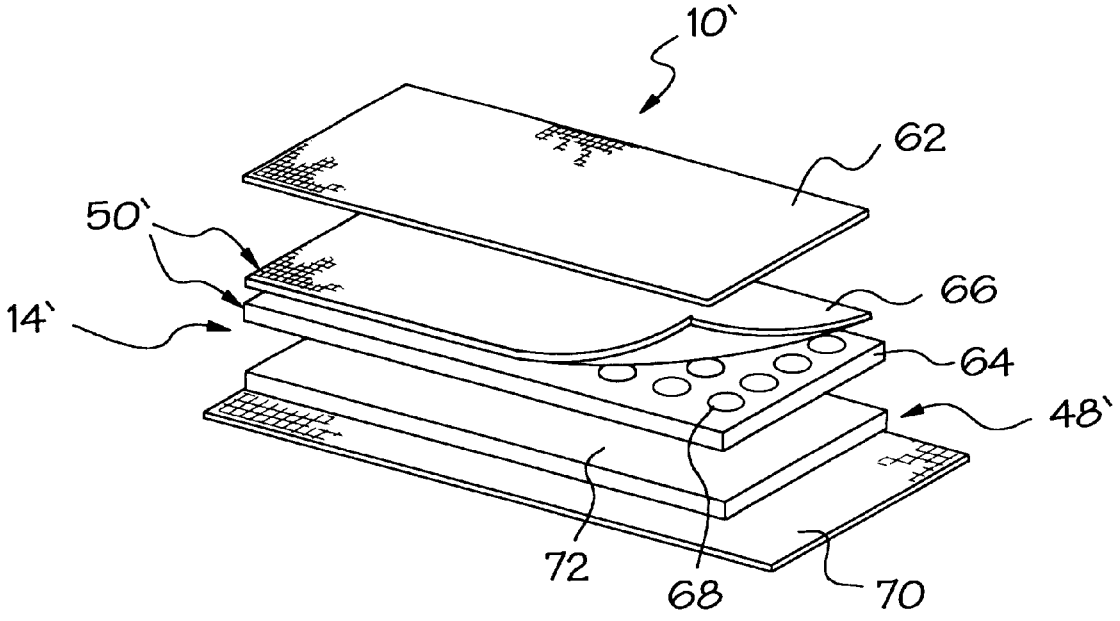
FIG. 4 is a detail in perspective of an alternate embodiment of the invention.

As shown in FIG. 4, in an alternate embodiment of the invention, the inner liner 14' of the garment ensemble 10' is modified from the construction shown in FIGS. 1–3 in the following manner. The outermost layer of the inner liner 14' comprises a thermal layer 50' which extends throughout the entire inner liner and includes a layer 64 of flame and heat resistant closed-cell apertured foam which is attached to a substrate layer 66 of pajama check weave aramid polymer material, such as NOMEX, by a suitable adhesive. The adhesive preferably is laid down in dots or lines so that the apertures 68 are not obstructed. The foam material of layer 64 is a neoprene or polyvinyl nitrile foam described in co-pending U.S. application Ser. No. 08/119,474 filed Sep. 10, 1993, the disclosure of which is incorporated herein by reference. An appropriate material for layer 64 is ENSOLITE brand closed cell foam styles IV1, IV2, IV3, IV4, IV5, GIC and IVC, manufactured by Ensolite, Inc. of Mishawaka, Ind.

The moisture barrier 48', which extends throughout the entire inner liner 14', includes a layer of filament facecloth 70, preferably about 3 ounces per square yard, bonded to or coated with a layer 72 of a semi-permeable membrane material such as GORE-TEX. The thermal layer 64 does not appreciably absorb moisture, and therefore is positioned between the moisture barrier 48' and the outer shell 62 of the ensemble 10'. This orientation promotes moisture vapor transport from within the garment (generated by the wearer) through the moisture barrier 48' because the flow of moisture vapor to the moisture barrier is not obstructed by a thermal barrier, which otherwise would be positioned between the wearer and the moisture barrier. The breathability of the inner liner 14' is enhanced by the apertures 68 of the foam layer 64. Further, the filament face cloth provides a measure of lubricity to the inner liner 14', which facilitates donning and doffing of the garment, and reduces friction between the garment and the wearer, which reduces wearer stress and facilitates ease of movement.

Further, the substrate 66 of the foam thermal liner 64, which is needed to provide dimensional stability to the foam and protect it from external abrasion, also doubles as the outer shell of the inner liner 14'. Similarly, the substrate 70 of the moisture barrier 48' provides dimensional stability to the membrane 72 and also doubles as a facecloth for the entire garment 10'.

In conclusion, the present invention provides a multi-use garment 10 having an outer shell 12 and an inner liner 14 which are configurable into four distinct garments. The outer shell 12 and inner liner 14 combine to form a first garment ensemble 10 which functions as a turnout coat meeting the N.F.P.A. 1971 performance standard; the inner liner 14 is itself a second garment which functions both as an EMS jacket meeting the N.F.P.A. 1999 performance standard and as a station uniform jacket; and the outer shell 12 is itself a third garment which functions as a wildlands brush fire firefighting garment meeting the N.F.P.A. 1977 performance standard. The relevant N.F.P.A. performance requirements are given in the table below for the three N.F.P.A. standards mentioned above (an "X" stands for a test or a standard which must be met according to the particular chapter):

| Performance Requirements | NFPA 1971 | NFPA 1977 | NFPA 1999 |
|---|---|---|---|
| Flame Resistance Test 5903.1 | X | X | |
| Heat/Thermal Shrink Oven Test (500° F. for 5 minutes) | X | X | |
| Thread Heat Resistance Test (500° F. for 5 minutes) | X | X | |
| Seam Strength - Woven ASTM D1683 (D751) | X | X | X |
| Knits ASTM D3940 | | X | |
| Thermal Protective Performance Test (TPP) | X | | |
| Cleaning Shrinkage AATCC 135 | X | X | |
| Tear Resistance Fabric Elmendorf ASTM D 1424 | X | X | X |
| Char Resistance Fabric | X | | |
| Water Absorption Fabric | X | | |
| Water Penetration Fabric | X | | |
| Reflective Trim Retro-Reflective & Fluorescent | X | | |
| Hardware Corrosion Resistance | X | | |
| Hardware Heat Resistance | X | | |
| Watertight Integrity Test ASTM F1359 | | | X |
| Bacteriophage PHI-X-174 | | | X |
| Tensile Strength ASTM D 751 | | | X |
| Closure Break Strength | | | X |
| Burst Strength ASTM D751 | | | X |
| Puncture Resistance ASTM D 2582 | | X | |
| Radiant Protection Performance ASTM D 4108 | | X | |
| Heat Loss ASTM D 1518 | | X | |

Having described the invention in detail and by reference to the drawings, it will be apparent that modification and variations are possible without departing from the scope of the invention as defined in the following claims.

What is claimed is:

1. A multi-use hazardous duty jacket ensemble having sleeve portions and a body portion comprising:

an outer shell;

an inner liner positioned within said outer shell, said inner liner being separable from said outer shell and adapted to be worn separately as a second hazardous duty jacket; and a fastening system for releasably attaching said inner liner to said outer shell;

said inner liner comprising a body portion, sleeve portions attached to said body portion and a closure attached to said body portion for securing said second jacket about a wearer;

said body portion and said sleeve portions of said inner liner further including an outer layer of abrasion, flame and heat resistant material; a layer of moisture barrier material inside of said outer layer; and a layer of thermal barrier material inside of said outer layer;

said outer layer of abrasion, flame and heat resistant material being selected from a group consisting of an aramid polymer fabric material, a blend of aramid polymer fabric materials, a polybenzamidazole material, and a blend of aramid polymer fabric and polybenzamidazole materials.

2. The ensemble of claim 1, wherein said inner liner further comprises strips of reflective material attached over said outer layer.

3. The ensemble of claim 1, wherein said inner liner further comprises a flap shaped to substantially cover said closure of said inner liner to substantially block transmission of fluid borne and blood borne pathogens through said closure of said inner liner.

4. The ensemble of claim 1, wherein said inner liner further comprises a collar attached to said body portion of said inner liner.

5. The ensemble of claim 1, wherein said outer shell comprises a body portion; and sleeve portions attached to said body portion of said outer shell wherein said outer shell is adapted to be worn separately from said inner liner as a third jacket.

6. The ensemble of claim 5, wherein said body portion and said sleeve portions of said outer shell comprise a layer of abrasion, flame and heat resistant material capable of withstanding 500° F. for five minutes without burning, melting or separating.

7. The ensemble of claim 5, wherein said body portion and said sleeve portions of said outer shell comprise a layer of material selected from a group consisting of an aramid polymer material and a polybenzamidazole material.

8. The ensemble of claim 7, wherein said outer shell further comprises a closure for securing said third jacket about a wearer.

9. A multi-use hazardous duty jacket ensemble comprising:

an outer shell including a body portion and sleeve portions attached to said body portion, said body portion of said outer shell including a left-front panel and a right-front panel meeting at a vertical opening;

an inner liner positioned within said outer shell, said inner liner being separable from said outer shell and adapted to be worn separately as a second hazardous duty jacket, said inner liner including a body portion and sleeve portions attached to said body portion, said body portion of said inner liner including a left-front panel and a right-front panel meeting at a vertical opening;

a first closure attached to said body portion of said outer shell for securing said left-front panel of said outer shell to said right-front panel of said outer shell at said vertical opening of said outer shell; and a fastening system for releasably attaching said inner liner within said outer shell, said fastening system including, a first slide fastener strip attached to an inner surface of said left-front panel of said outer shell, approximate said vertical opening of said outer shell, a second slide fastener strip attached to an inner surface of said rightfront panel of said outer shell, approximate said vertical opening of said outer shell, a third slide fastener strip attached to said left-front panel of said inner liner, approximate said vertical opening of said inner liner, engaged with said first slide fastener strip, and a fourth slide fastener strip attached to said right-front panel of said inner liner, approximate said vertical opening of said inner liner, engaged with said second slide fastener strip;

wherein when said inner liner is worn separately as said second hazardous duty jacket, said third and fourth slide fastener strips engage to provide a second closure for securing said left-front panel of said inner liner to said right-front panel of said inner liner at said vertical opening of said inner liner.

10. The multi-use hazardous duty jacket ensemble of claim 9, wherein said inner liner further includes a pair of knit wristlets, each attached to a distal end of a respective sleeve portion of said inner liner, and a collar attached to a neck portion of said body portion of said inner liner.

11. The multi-use hazardous duty jacket ensemble of claim 9, wherein:

said outer shell includes a first storm flap shaped to cover said first closure; and said inner liner includes a second storm flap shaped to cover said second closure.

* * * * *